US007654346B2

(12) United States Patent
Overstreet et al.

(10) Patent No.: US 7,654,346 B2
(45) Date of Patent: Feb. 2, 2010

(54) STEEL TOOTH DRILL BIT WITH IMPROVED TOOTH BREAKAGE RESISTANCE

(75) Inventors: James L. Overstreet, Tomball, TX (US); Robert J. Buske, The Woodlands, TX (US); Kenneth E. Gilmore, Cleveland, TX (US); Jeremy K. Morgan, Midway, TX (US)

(73) Assignee: Baker Hughes Incorporated, Houston, TX (US)

( * ) Notice: Subject to any disclaimer, the term of this patent is extended or adjusted under 35 U.S.C. 154(b) by 136 days.

(21) Appl. No.: 11/804,607

(22) Filed: May 18, 2007

(65) Prior Publication Data

US 2008/0283304 A1 Nov. 20, 2008

(51) Int. Cl.
*E21B 10/08* (2006.01)

(52) U.S. Cl. ..... 175/374; 175/425

(58) Field of Classification Search ..... 175/374, 175/425, 432

See application file for complete search history.

(56) References Cited

U.S. PATENT DOCUMENTS

| | | | | |
|---|---|---|---|---|
| 5,425,288 | A | 6/1995 | Evans | |
| 5,492,186 | A * | 2/1996 | Overstreet et al. | 175/374 |
| 5,755,299 | A | 5/1998 | Langford, Jr. et al. | |
| 6,029,759 | A * | 2/2000 | Sue et al. | 175/374 |
| 6,196,338 | B1 | 3/2001 | Slaughter et al. | |
| 6,360,832 | B1 | 3/2002 | Overstreet et al. | |
| 6,374,704 | B1 | 4/2002 | Scott et al. | |
| 6,766,870 | B2 * | 7/2004 | Overstreet | 175/374 |

* cited by examiner

*Primary Examiner*—Jennifer H Gay
*Assistant Examiner*—David Andrews
(74) *Attorney, Agent, or Firm*—Bracewell & Giuliani LLP

(57) ABSTRACT

A drill bit having steel teeth is provided with a combination of hardfacing materials on the teeth. The bases of the teeth are hardfaced with nickel-based materials to significantly reduce any potential cracking therein. Portions of the supporting cones adjacent the teeth also may be fabricated with the nickel-based hardfacing. All other portions of the teeth are hardfaced with iron-based materials.

13 Claims, 3 Drawing Sheets

STEEL TOOTH DRILL BIT WITH IMPROVED TOOTH BREAKAGE RESISTANCE

BACKGROUND OF THE INVENTION

1. Technical Field

The present invention relates in general to drill bits and, in particular, to an improved system, method, and apparatus for a steel tooth drill bit having enhanced tooth breakage resistance.

2. Description of the Related Art

In the prior art, steel tooth drill bits are great tools for drilling multiple formations due to the ability of their teeth to flex when encountering hard formations. However, this ability to provide flexure can cause cracking at the base of the teeth in the weld deposit and carburized area under the iron-based hardfacing deposits. Moreover, the cracks can grow during service or can aggravate pre-existing thermal cracks from the initial manufacturing process.

The manufacturing cracks can be caused by a variety of sources, but are primarily from the thermal stresses induced during the welding process while using iron-based hardfacing materials at the base of the teeth and subsequent hardening and carburization of the cone. The hardfacing can relieve the stress in the form of a crack. The cracks can propagate directly into the base steel of the teeth and/or the cone shell. The extent of the cracking is dependent upon the thermal management of the cone during the heat-up, welding, and the cooling down of the cone. Another factor affecting the extent of the cracking is how brittle the carburized case is underneath the hardfacing deposit.

During operation, the combination of the flexing of the teeth, formations drilled, operating parameters, and the corrosive environment can cause the cracks to grow while the drill bit is in service. This crack propagation can cause the teeth to eventually break off or cause the cracks to grow into the cone shell, both of which impede performance.

It is known that nickel-based hardfacing minimizes the transport of carbon into the steel substrate and generally does not produce a carburized case in the steel underneath the hardfacing deposit. In addition, the thermal stresses in nickel-based hardfacing are not as great as in iron-based hardfacing, such that nickel-based hardfacing is less likely to have thermal cracks. Nickel-based hardfacing is also very corrosion resistant compared to iron-based hardfacing.

SUMMARY OF THE INVENTION

In general, if cracks occur in nickel-based hardfacing they typically arrest in the hardfacing deposit and generally do not propagate into the steel substrate. This is primarily due to the round blunt tip crack of nickel-based materials, contrasted with the sharp tip crack in iron-based materials. However, iron-based hardfacing materials are more durable than current nickel-based hardfacing materials. The area of the teeth that receives most of the damage due to impacting is at or near the top of the teeth. Therefore, the crest and a portion of the flanks require a highly durable iron-based hardfacing. Since the bases of the teeth do not receive significant impacting those portions are very suitable for nickel-based hardfacing. By placing the nickel-based hardfacing at least at the bases of the teeth and/or the surrounding cone shell, the overall durability of the drill bit is improved.

Typically, the hardfacing is applied by an oxygen acetylene welding process, but other welding or coating processes of applying the hardfacing material may be used. Some high-content nickel alloys with hard component materials also may be used.

The bases of the teeth are provided with nickel-based hardfacing to significantly reduce any potential cracking therein and in the adjacent areas of the cone. All other portions of the teeth are hardfaced with iron-based materials such that all surfaces of the teeth are protected with one or the other type of hardfacing. In addition, manufacturers of drill bits prefer to weld with nickel-based materials due to ease of heat management in the teeth base and cone surface areas of the cutting structure.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention, which will become apparent, are attained and can be understood in more detail, more particular description of the invention briefly summarized above may be had by reference to the embodiments thereof that are illustrated in the appended drawings which form a part of this specification. It is to be noted, however, that the drawings illustrate only some embodiments of the invention and therefore are not to be considered limiting of its scope as the invention may admit to other equally effective embodiments.

DETAILED DESCRIPTION OF THE INVENTION

Figure 1:
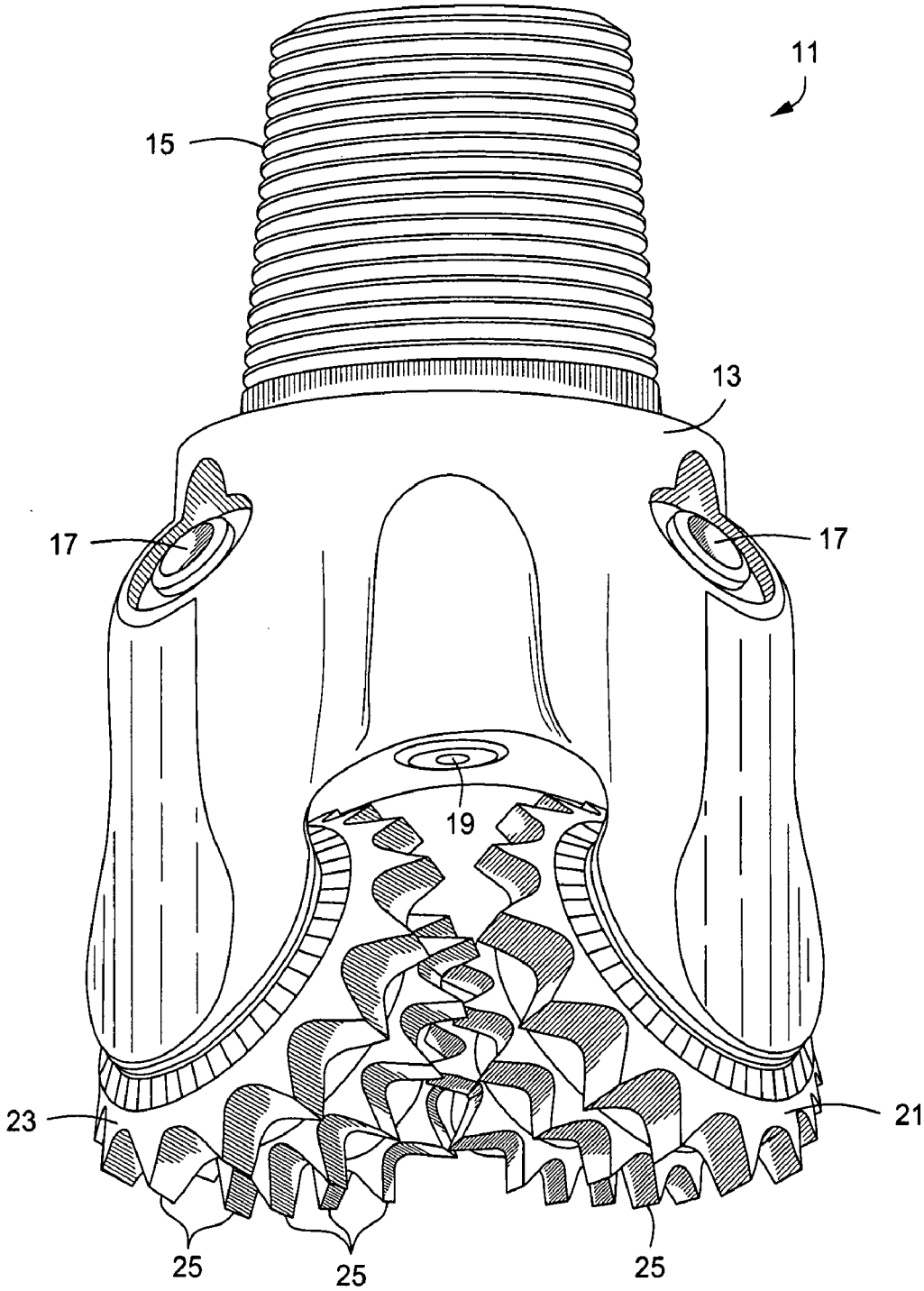
FIG. 1 is an isometric view of one embodiment of a drill bit constructed in accordance with the invention.

Referring to FIG. 1, one embodiment of a system, method, and apparatus for an earth boring bit 11 constructed in accordance with the invention is shown. Earth boring bit 11 includes a bit body 13 having threads 15 at its upper end for connecting bit 11 into a drill string (not shown). Bit 11 is depicted with three legs, and each leg of bit 11 is provided with a lubricant compensator 17. At least one nozzle 19 is provided in bit body 13 for spraying cooling and lubricating drilling fluid from within the drill string to the bottom of the bore hole.

At least one cutter is rotatably secured to each leg of the bit body 13. Preferably three cutters 21, 23 (one cutter being obscured from view in the perspective view of FIG. 1) are rotatably secured to the bit body 13. A plurality of teeth 25 are arranged in generally circumferential rows on cutters 21, 23. Teeth 25 may be integrally formed from the material of cutters 21, 23, which is typically steel.

Figure 2:
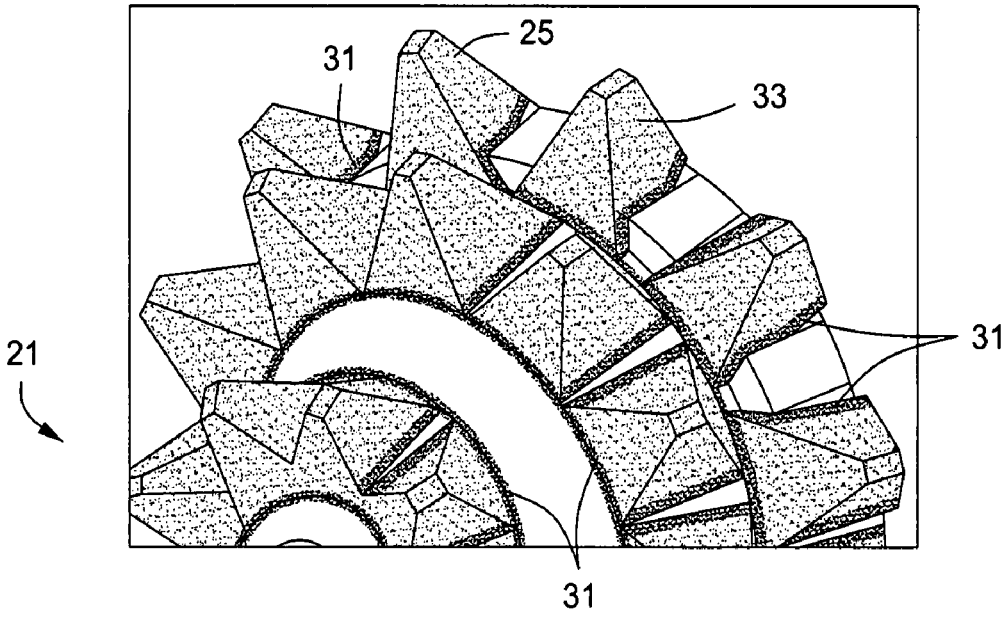
FIG. 2 is an enlarged photographic image of one embodiment of a cutter on the drill bit of FIG. 1 and is constructed in accordance with the invention.
Figure 3:
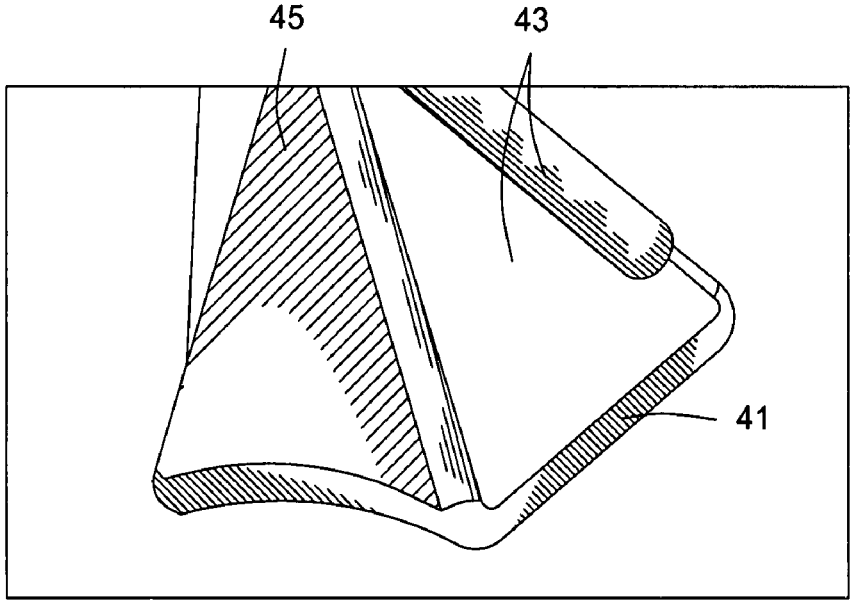
FIG. 3 is an enlarged photographic image of another embodiment of a cutter on the drill bit of FIG. 1 and is constructed in accordance with the invention.

Referring now to FIGS. 2 and 3, two embodiments of earth boring bits having cutters 21, 23 or roller cones that employ the novel elements of the invention are shown. Although the cutters 21, 23 and teeth 25 are shown with certain types of geometry, those skilled in the art will recognize that the invention is not limited to the illustrated embodiments.

For example, in the enlarged view of FIG. 2, the teeth 25 on the cutter 21 of the earth boring bit are shown with two different types of hardfacing materials 31, 33 formed thereon. The invention may be applied to only some of the teeth or all of the teeth, and on one of the cutters or all of the cutters. Furthermore, the invention also may be applied to other teeth or other portions of the drill bit other than the cutters. The first type of hardfacing 31 is formed from a nickel-based material and is located on proximal or base portions 35 of at least some of the teeth 25. Optionally, the first hardfacing may comprise an alloy, such as a nickel alloy, or an alloy having a high nickel content with some hard component materials such as, for example, monocrystalline WC, sintered WC (crushed or spherical), cast WC (crushed or spherical), and/or with a matrix of Ni—Cr—B—Si. In the embodiment of FIG. 2, the first hardfacing 31 also is located on surfaces of the cutter 21 adjacent the aforementioned teeth 25, such that the first hardfacing 31 smoothly transitions from the cutter 21 to the teeth 25.

The second type of hardfacing 33 is formed from an iron-based material and is located on distal or upper portions of the same teeth with hardfacing 31. Thus, all surfaces of the teeth 25 and, optionally, portions or the entire surface of the cutter 21 itself is protected with hardfacing materials. The second hardfacing 33 may be located at and adjacent to the top portions of the teeth 25, such as on the crests and portions of the flanks of the teeth. Optionally, and as shown in FIG. 3, only the base portions of teeth 45 on cutter 40 may be provided with the first hardfacing 41 (i.e., without application of hardfacing 41 directly to the surfaces of cutter 40). The remaining portions of teeth 45 are protected by the second hardfacing 43, as described herein.

Figure 4:
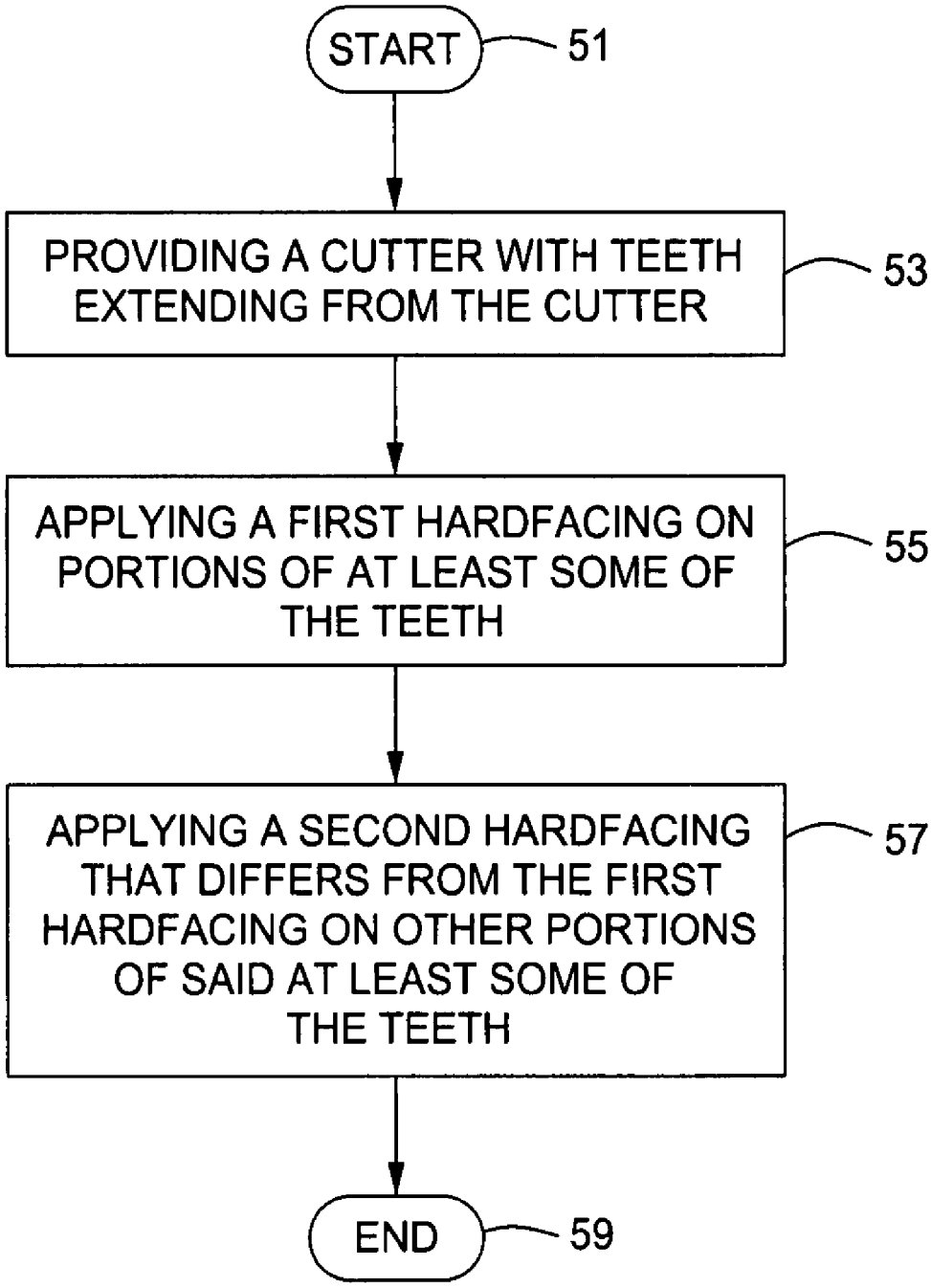
FIG. 4 is a high level flow diagram of one embodiment of a method constructed in accordance with the invention.

Referring now to FIG. 4, the invention also comprises a method of fabricating a cutter for an earth boring bit. The method begins as indicated at step 51, and comprises providing a cutter with teeth extending from the cutter (step 53); applying a first hardfacing on portions of at least some of the teeth (step 55); applying a second hardfacing that differs from the first hardfacing on other portions of said at least some of the teeth (step 57); before ending as indicated at step 59.

Alternatively, the method may comprise one or more of the following steps, including: applying the first hardfacing on base portions of said at least some of the teeth, and/or on surfaces of the cutters adjacent said at least some of the teeth; and/or applying the second hardfacing to crests and portions of flanks of said at least some of the teeth. In addition, one embodiment of the method may comprise sequentially applying nickel-based hardfacing (e.g., a high-content nickel alloy with hard component materials) as the second hardfacing, after applying iron-based hardfacing as the first hardfacing.

While the invention has been shown or described in only some of its forms, it should be apparent to those skilled in the art that it is not so limited, but is susceptible to various changes without departing from the scope of the invention.

What is claimed is:

1. An earth boring bit, comprising:

a bit body having legs;

a cutter rotatably secured to each leg of the bit body to define a plurality of cutters, each cutter having a plurality of teeth extending therefrom;

a first hardfacing formed from a first material and located on and completely surrounding base portions of at least some of the teeth adjacent the cutters;

a second hardfacing formed from a second material that differs from the first material and is located on other portions of said at least some of the teeth; and wherein the second hardfacing is located at and adjacent tops and on all other portions of said at least some of the teeth other than the base portions.

2. An earth boring bit according to claim 1, wherein the first hardfacing also is located on surfaces of the cutters adjacent the base portions of said at least some of the teeth such that the first hardfacing smoothly transitions from the cutters to said at least some of the teeth.

3. An earth boring bit according to claim 1, wherein said tops comprise crests and portions of flanks of said at least some of the teeth.

4. An earth boring bit according to claim 1, wherein the first material comprises nickel-based hardfacing, and the second material comprises iron-based hardfacing.

5. An earth boring bit according to claim 1, wherein the first material comprises an alloy having high nickel content with hard component materials comprising at least one of: monocrystalline WC, sintered WC, cast WC, and a matrix of Ni—Cr—B—Si.

6. An earth boring bit according to claim 1, wherein the first material comprises a nickel alloy.

7. An earth boring bit according to claim 1, wherein the teeth are integrally formed from a material of the cutters comprising steel.

8. An earth boring bit, comprising:

a bit body having legs;

a cutter rotatably secured to each leg of the bit body to define a plurality of cutters, each cutter having a plurality of teeth extending therefrom;

a nickel-based hardfacing located on and completely surrounding base portions of the teeth adjacent the cutters, and on surfaces of the cutters adjacent the base portions, such that the nickel-based hardfacing smoothly transitions from the cutter to the teeth; and an iron-based hardfacing located on all other portions of the teeth other than the base portions.

9. An earth boring bit according to claim 8, wherein the nickel-based hardfacing comprises an alloy having a high nickel content with some hard component materials comprising at least one of: monocrystalline WC, sintered WC, cast WC, and a matrix of Ni—Cr—B—Si.

10. An earth boring bit according to claim 8, wherein the teeth are arranged in generally circumferential rows on the cutters, and the teeth are integrally formed from a material of the cutters comprising steel.

11. A method of fabricating a cutter for an earth boring bit, comprising:

(a) providing a cutter with teeth extending from the cutter;

(b) applying a first hardfacing on and completely surrounding base portions of at least some of the teeth and on surfaces of the cutter adjacent the base portions, such that the first hardfacing smoothly transitions from the cutter to the teeth;

(c) applying a second hardfacing that differs from the first hardfacing on other portions of said at least some of the teeth other than the base portions; and wherein step (c) comprises applying the second hardfacing all other portions of said at least some of the teeth, including crests and portions of flanks of said at least some of the teeth.

12. A method according to claim 11, wherein step (b) comprises applying nickel-based hardfacing as the first hardfacing after step (c), and step (c) comprises applying iron-based hardfacing as the second hardfacing before step (b).

13. A method according to claim 11, wherein step (b) comprises applying an alloy having a high nickel content with hard component materials comprising at least one of: monocrystalline WC, sintered WC, cast WC, and a matrix of Ni—Cr—B—Si.

* * * * *

UNITED STATES PATENT AND TRADEMARK OFFICE

CERTIFICATE OF CORRECTION

PATENT NO. : 7,654,346 B2
APPLICATION NO. : 11/804607
DATED : February 2, 2010
INVENTOR(S) : James L. Overstreet et al.

It is certified that error appears in the above-identified patent and that said Letters Patent is hereby corrected as shown below:

Column 2, line 33, delete "enlarged photographic image" and insert --view--
Column 2, line 36, delete "photographic image" and insert --view--

Signed and Sealed this

Sixth Day of July, 2010

David J. Kappos

David J. Kappos
*Director of the United States Patent and Trademark Office*